United States Patent [19]

Atkin

[11] Patent Number: 4,707,987

[45] Date of Patent: Nov. 24, 1987

[54] EXHAUST SYSTEM FOR INTERNAL COMBUSTION ENGINE

[76] Inventor: Graham E. Atkin, 2 Harmer La., Cringleford, United Kingdom

[21] Appl. No.: 785,759

[22] Filed: Oct. 9, 1985

[30] Foreign Application Priority Data

Oct. 10, 1984 [GB] United Kingdom ..... 8425657

[51] Int. Cl.[4] ..... F01N 7/00

[52] U.S. Cl. ..... 60/324; 123/323

[58] Field of Search ..... 60/292, 324; 123/323

[56] References Cited

U.S. PATENT DOCUMENTS

| | | | |
|---|---|---|---|
| 3,234,924 | 2/1966 | May | 60/292 |
| 3,523,418 | 8/1970 | Marsee | 60/324 |
| 3,577,727 | 5/1971 | Warren | 60/292 |

*Primary Examiner*—William A. Cuchlinski, Jr.
*Attorney, Agent, or Firm*—Thomas J. Greer, Jr.

[57] ABSTRACT

A part of an exhaust system 1 for an internal combustion engine has a valve 2 which can be moved by means such as a vacuum actuator 3 from a fully open inoperative position to an operative position in which it restricts the exhaust passageway by a variable amount. In the operative position, resilient means such as a coil spring 8 urges the valve to close the exhaust passageway against the pressure of exhaust gases, thereby increasing the backpressure on the engine in a controlled way. This is done on start-up to reduce the warm-up time of the engine and to reduce hydrocarbon emissions. When the engine has warmed up, the actuator 3 moves the valve to its inoperative position.

7 Claims, 3 Drawing Figures

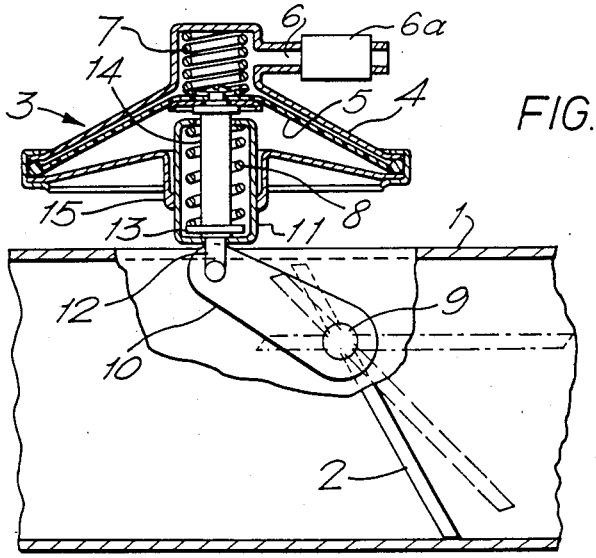
FIG.1.
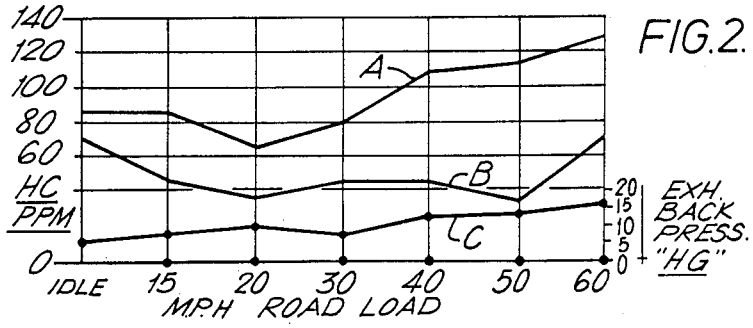
FIG.2.
FIG.3.
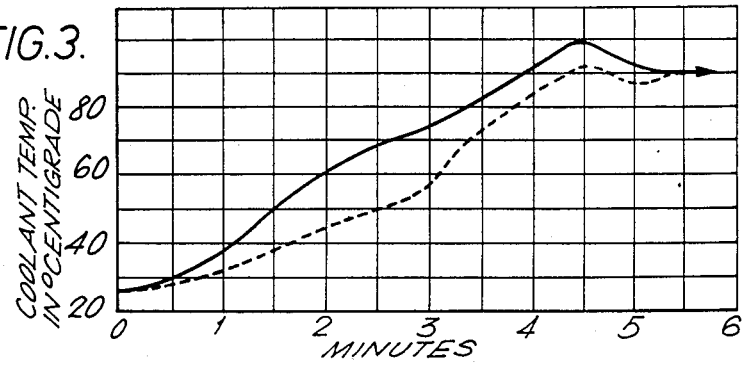

EXHAUST SYSTEM FOR INTERNAL COMBUSTION ENGINE

This invention relates to exhaust systems for internal combustion engines, especially spark ignition internal combustion engines.

It is known to provide valve means which close one of two branches of an exhaust system, so as to divert the exhaust gas through a bypass to the other branch during cold engine starts.

It is also known to provide valve means which restricts the exhaust passageway by varying amounts, the valve means being arranged so that opening is greater for greater steady values of the pressure of the exhaust gases. Such self-regulating valves are described for example in U.K. Patent Specification Nos. 1 043 865 and 1 063 091.

The invention provides an exhaust system for an internal combustion engine which comprises valve means which in an operative position restricts the exhaust passageway by varying amounts, the valve means being arranged so that the opening is greater for greater steady values of the pressure of the exhaust gases, and an actuator which is capable of moving the valve means to an inoperative position in which it remains with the exhaust passageway fully open.

The controlled increase of back pressure results in increased retention of hot exhaust gases in the cylinder after each combustion stroke, permitting quicker engine warm-up times to be achieved and reduced hydrocarbon emissions to be obtained. Unlike the prior arrangements, the valve means can be moved when desired to an inoperative position. Thus, the valve means may be moved from its operative to its inoperative position in response to sensing engine temperature or after a predetermined length of time after the engine has been started. In this way, the characteristic of the self-regulation can be chosen to be particularly suitable for engine warm-up whereas the prior arrangements must choose a compromise between ideal self-regulation for warm-up and ideal self-regulation thereafter.

Advantageously, the actuator moves the valve means to an operative position in response to the depression of the engine induction system. Preferably, the actuator can be subject to atmospheric pressure to move the valve means to its inoperative position. It will be understood however that the actuator will also move the valve means to its inoperative position in response to sudden fall in engine depression, e.g. when full acceleration is demanded.

Advantageously, there is provided a delay valve for delaying the movement of the valve means to in its inoperative position in response to removal of the depression of the engine induction system. Such a sudden increase could result from a sudden acceleration, and the delay means maintains the backpressure for a delay period to minimise hydrocarbon emissions.

The valve means may be connected to a member of the actuator (for example a diaphragm) movable against resilient means by means of the depression in the engine induction system, in order to be movable between its operative and inoperative positions. The connection may be via a linkage, and the spring rate may be chosen so that the opening of the valve means in its operative position according to the pressure of the exhaust gases is effected simply by means of the varying depression (which is related to the varying exhaust gas pressure) in the engine induction system. Alternatively, the valve means may be connected to the member movable by means of the engine depression by means of further resilient means, and in this case, the controlled opening of the valve means in its operative position may be by virtue of the pressure of exhaust gases deflecting the valve means against the further resilient means.

The invention is particularly suitable for a spark ignition engine.

An exhaust system for a spark ignition internal combustion engine having valve means for restricting the passageway will now be described, by way of example, with reference to the accompanying drawings, in which:

FIG. 1 is an axial cross-section of the part of the exhaust system containing the valve means;

FIG. 2 is a graph showing the effect of the valve means on hydrocarbon emissions during typical vehicle road load maintained conditions; and FIG. 3 is a graph showing the effect of the valve means on the rate of rise of engine temperature.

Referring to the drawings, a length of the exhaust system 1 contains a butterfly valve 2 which is movable between an operative position in which it partially closes the exhaust passageway and an inoperative position in which the passageway is fully open, by means of an actuation means indicated generally by the reference numeral 3.

The actuation means 3 has a housing 4 divided by a flexible diaphragm 5. The lower side of the diaphragm (as seen in FIG. 1) is subject to atmospheric pressure, whereas the upper side can be connected via integral pipe 6 either with manifold depression (by means which are not shown) or with atmospheric pressure. As seen in FIG. 1, pipe 6 is in communication with manifold depression and diaphragm 5 is sucked up with the top of the housing against a return spring 7. If the pipe 6 is vented to atmosphere, the diaphragm 5 would descend to a lower position under the force of the spring.

The butterfly valve 2 is connected to the diaphragm via a mechanical linkage and via resilient means in the form of coil spring 8. Spindle 9 of butterfly valve is secured to link 10 which is in turn secured to tube 11 via link 12. Tube 11 is turned over at its upper end to form a seat for one end of coil spring 8. The other end of coil spring 8 seats on abutment 13 which extends from rod 14 connected at its upper end to diaphragm 5.

Consequently, with the diaphragm 5 in the illustrated position, the butterfly valve 2 is in the solid line position in which it nearly closes the exhaust passageway. However, the valve 2 can resiliently deflected from that position by the pressure of exhaust gas upstream of the valve, against the force of the coil spring 8. The diaphragm 5, the rod 14 and the abutment 13 remain in the illustrated position, but the tube 11 can move downwards guided by guide 15 against the coil spring 8, and the butterfly valve can move to a partly closed position such as the broken-line position illustrated. The valve is arranged and shaped so that it cannot completely close the exhaust passageway, a small gap being left between the passageway at the top and sides of the valve when the bottom of the valve is in contact with the passageway. The valve may remain in this position when the engine is idling, as the backpressure may then be insufficient to deflect the valve against the spring.

When the diaphragm 5 returns to its unstressed position, the rod 14 descends, the abutment 13 acting directly on the turned-in bottom of the tube 11, until the butterfly valve is in the horizontal fully open inoperative position shown by a dashed and dotted line. While the butterfly valve is free in this position to pivot in an anticlockwise direction against the force of the spring 8, the exhaust gas will not exert any steady force on it and so the valve will remain in this position.

A timer (not shown) is provided which after a predetermined time period breaks the connection of the pipe 6 to the inlet manifold, connecting it instead to atmospheric pressure. A typical suitable period is 5 minutes. The purpose is to ensure that the butterfly valve 2 is in the inoperative position when the engine has warmed up. As an alternative, the timer could be replaced by a temperature sensor sensing engine temperature and arranged to interrupt the suction signal when predetermined engine temperature has been reached.

A delay valve 6*a* is also provided which may be in the form of a constriction in the vacuum connection to the pipe 6.

In operation, when the engine is started from cold, the butterfly valve 2 is in its operative position. Thus, the valve increases the back pressure of the engine, since it is being biased by depression 6 and coil spring 8 to a position nearly closing the exhaust passageway. For low steady loads, the valve is opened to some extent until there is a balance between the forces due to the exhaust pressure and those due to the coil spring. The increased back pressure at the engine exhaust manifold has two consequences.

First, less exhaust gas escapes from the cylinders on the exhaust stroke, and the retained exhaust gas results in heat being retained in the engine. Second, the last part of the gases to excape on the exhaust stroke are typically those with the highest concentration of unburnt hydrocarbons. Consequently, this part is retained in the cylinder and at least some of it combusts on the next combustion stroke. It follows that hydrocarbon emissions are reduced with the valve means of the invention.

The increased backpressure and advantages resulting therefrom are maintained at higher road loads, the valve opening gradually for increased steady exhaust gas pressures to establish a balance between the forces due to the backpressure and those due to the spring.

During transient accelerations, the inlet manifold depression becomes less because the engine throttle has been opened. Although the depression is responsible to maintaining the butterfly valve 2 in its operative position, the valve does not move immediately to its inoperative position because of the delay valve 6*a* in the connection to the pipe 6. Because of the delay valve, the loss of suction is gradual (of the order of a second), and the backpressure is initially maintained. The valve gradually moves to its inoperative position in the interests of obtaining full power from the engine.

When the engine has warmed up, the depression signal to the actuation means is interrupted, and the valve is moved to its inoperative fully open position.

FIG. 3 is a graph of coolant temperature and time for an engine fitted with an exhaust system according to the invention in a particular vehicle, the full line referring to when the butterfly valve 2 is in operation, the broken line to when the butterfly valve is not in operation. It will be observed that the time for warm-up to 60° C. is reduced from about 3 minutes to about 2 minutes.

FIG. 2 (lines A and B) is a graph of hydrocarbon content in parts per million against road load in m.p.h. obtained from a vehicle the engine of which was fitted with an exhaust system according to the invention. The vehicle was progressively accelerated on flat ground so that, at each steady vehicle speed, the engine load was the minimum needed to overcome rolling resistance, aerodynamic resistance and all other losses (that is the engine load was equal to the so-called "road load"). Line A shows the hydrocarbon emissions when the butterfly valve 2 is inoperative and line B shows the emissions when the butterfly valve is operative. It will be observed that the emissions are reduced with the valve operative at all road loads. Line C shows the exhaust backpressure in inches of mercury against road load in m.p.h.

Various modifications are of course possible without departing from the scope of the invention. Thus, for example, the spring 8 may be omitted and the butterfly valve 2 can be connected directly by means of a linkage to the diaphragm 5. By choosing a spring 7 of appropriate rate, the valve may be controlled by the depression above the diaphragm and the spring 7 alone. Thus, at idling, the valve 2 closes the exhaust passageway. As the load increases, the valve 2 is again progressively opened in accordance with steady exhaust gas pressure, since the exhaust gas pressure is directly related to manifold depression, and the position of the valve 2 depends on manifold depression. For transient accelerations, there will again be a delay between the acceleration and reduction in engine suction and the movement of the valve 2 (hence maintaining backpressure) due to the delay valve 6*a* in the inlet manifold connection to the pipe 6. Finally, the valve 2 will be moved to the inoperative position in the same way if the pipe 6 is vented to atmosphere.

Also, the period for which the delay valve delays the effect on the actuator of pressure changes may be variable: for example, it might be arranged to reduce progressively over the warm-up time. The full delay would apply when the engine was started, and the delay would be reduced as the engine warmed up. This would ensure progressive performance restoration.

I claim:

1. An exhaust system for an internal combustion engine which comprises valve means in an exhaust passageway which in an operative position restricts said exhaust passageway by varying amounts, the valve means being arranged so that the opening is greater for greater steady values of the pressure of the exhaust gases, and an actuator which moves the valve means to an inoperative position in which it remains with the exhaust passageway fully open, wherein the actuator moves the valve means to an operative position in response to the depression of the engine induction system, and including a delay valve for delaying the movement of the valve means to its inoperative position in response to removal of the depression of the engine induction system.

2. An exhaust system as claimed in claim 1, wherein the delay valve comprises a constriction in a connection of the actuator to the engine induction system.

3. An exhaust system as claimed in claim 1, wherein the actuator moves the valve means to the inoperative position in response to connection to atmospheric pressure.

4. An exhaust system as claimed in claim 1 wherein the valve means is in its operative position urged by rsilient means in a direction to restrict the passageway, and the valve means is arranged to open against the resilient means due to the pressure of exhaust gases in the exhaust passageway.

5. An exhaust system as claimed in claim 1 wherein the valve means is moved from its operative to its inoperative position when the engine temperature reaches a predetermined value.

6. An exhaust system as claimed in claim 1 wherein the valve means is moved from its operative to its inoperative position after a predetermined time from starting the engine.

7. An exhaust system as claimed in claim 1 wherein the valve means is a butterfly valve.

* * * * *